US008327599B2

(12) United States Patent
Gavin

(10) Patent No.: US 8,327,599 B2
(45) Date of Patent: Dec. 11, 2012

(54) UNIVERSAL SPACER FOR CONCRETE REINFORCEMENT RODS AND WIRE

(75) Inventor: Peter W. Gavin, Durham, CT (US)

(73) Assignee: Polylok Inc., Wallingford, CT (US)

( * ) Notice: Subject to any disclaimer, the term of this patent is extended or adjusted under 35 U.S.C. 154(b) by 167 days.

(21) Appl. No.: 12/625,838

(22) Filed: Nov. 25, 2009

(65) Prior Publication Data

US 2011/0120045 A1 May 26, 2011

(51) Int. Cl.
*E04C 5/16* (2006.01)

(52) U.S. Cl. ..... 52/677; 52/680

(58) Field of Classification Search ..... 52/677, 52/680, 689, 633

See application file for complete search history.

(56) References Cited

U.S. PATENT DOCUMENTS

| | | | |
|---|---|---|---|
| 3,300,930 | A | 1/1967 | Weise |
| 3,348,347 | A | 10/1967 | Berry |
| 3,694,989 | A | 10/1972 | Oliver et al. |
| 3,783,574 | A | 1/1974 | Cennerelli |
| 3,913,187 | A | 10/1975 | Okuda |
| 5,347,787 | A | 9/1994 | Gavin |

FOREIGN PATENT DOCUMENTS

| | | |
|---|---|---|
| DE | 1270774 | 6/1968 |
| EP | 0352438 | 1/1990 |

*Primary Examiner* — Basil Katcheves

(74) *Attorney, Agent, or Firm* — Wiggin and Dana LLP; Anthony P. Gangemi

(57) ABSTRACT

A spacer for positioning rods and wire in concrete is disclosed. In some embodiments, the spacer includes first and second saddle portions joined together via a connection mechanism. Spacing members are joined with the first and second saddle portions and first and second outer edges are joined with the spacing members opposite the first and second saddle portions. A conforming fixed centering tab having a centering groove is joined with the first saddle portion at first and second ends. An adjustable and conforming centering flap is joined with the second saddle portion at a first end via a hinge connection and includes a free second end opposite the first end. The centering flap has a length greater than a width of an opening of the second saddle portion. The connection mechanism is joined with the spacing members adjacent the outer edges for pivoting the first and second saddle portions.

14 Claims, 3 Drawing Sheets

UNIVERSAL SPACER FOR CONCRETE REINFORCEMENT RODS AND WIRE

BACKGROUND

Various spacers for positioning rebar, wire, mesh, and other structural members in concrete are well known. One of the most common includes a chair-type of device on top which structural members are balance. Such devices often tip over when the structural members are adjusted or during the concrete pour.

Other device are joined to the structural members and are able to move with the structural members without toppling and also maintain stability during most concrete pours. One such device is a universal spacer that is manufactured by Polylok Inc. of Wallingford, Conn. and described in U.S. Pat. No. 5,347,787, which is incorporated by reference as if disclosed herein in its entirety. However, known devices that are joined to structural members are typically unable to accommodate rebar and wire having smaller diameters. When used with smaller diameter rebar and wire, such devices typically do not stay in place and can allow for inconsistent positioning of the structural members.

SUMMARY

A spacer for positioning rods and wire in concrete is disclosed. In some embodiments, the spacer includes the following: a first saddle portion, a spacing member joined with the first saddle portion, and a first outer edge joined with the spacing member opposite the first saddle portion; a conforming fixed centering tab joined with the first saddle portion at first and second ends, the centering tab including a centering groove; a second saddle portion, a spacing member joined with the second saddle portion, and a second outer edge joined with the spacing member opposite the second saddle portion; an adjustable and conforming centering flap joined with the second saddle portion at a first end via a hinge connection and including a free second end opposite the first end, the centering flap having a length greater than a width of an opening of the second saddle portion; and a connection mechanism joined with the spacing members adjacent the outer edges, for pivoting the first and second saddle portions.

A spacer for positioning rods and wire in concrete is disclosed. In some embodiments, the spacer includes the following: a first portion including a first saddle portion, a spacing member joined with the first saddle portion, and a first outer edge joined with the spacing member opposite the first saddle portion, the first saddle portion including a conforming fixed centering tab joined with the first saddle portion at first and second ends, the centering tab including a centering groove; a second portion including a second saddle portion, a spacing member joined with the second saddle portion, and a second outer edge joined with the spacing member opposite the second saddle portion, the second saddle portion including an adjustable and conforming centering flap joined with the second saddle portion at a first end via a hinge connection and including a free second end opposite the first end, the centering flap having a length greater than a width of an opening of the second saddle portion; and a connection mechanism for releasably connecting the first and second portions so that the first and second saddle portions are positioned adjacent one another to define an aperture for retaining the rods and wire.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1:
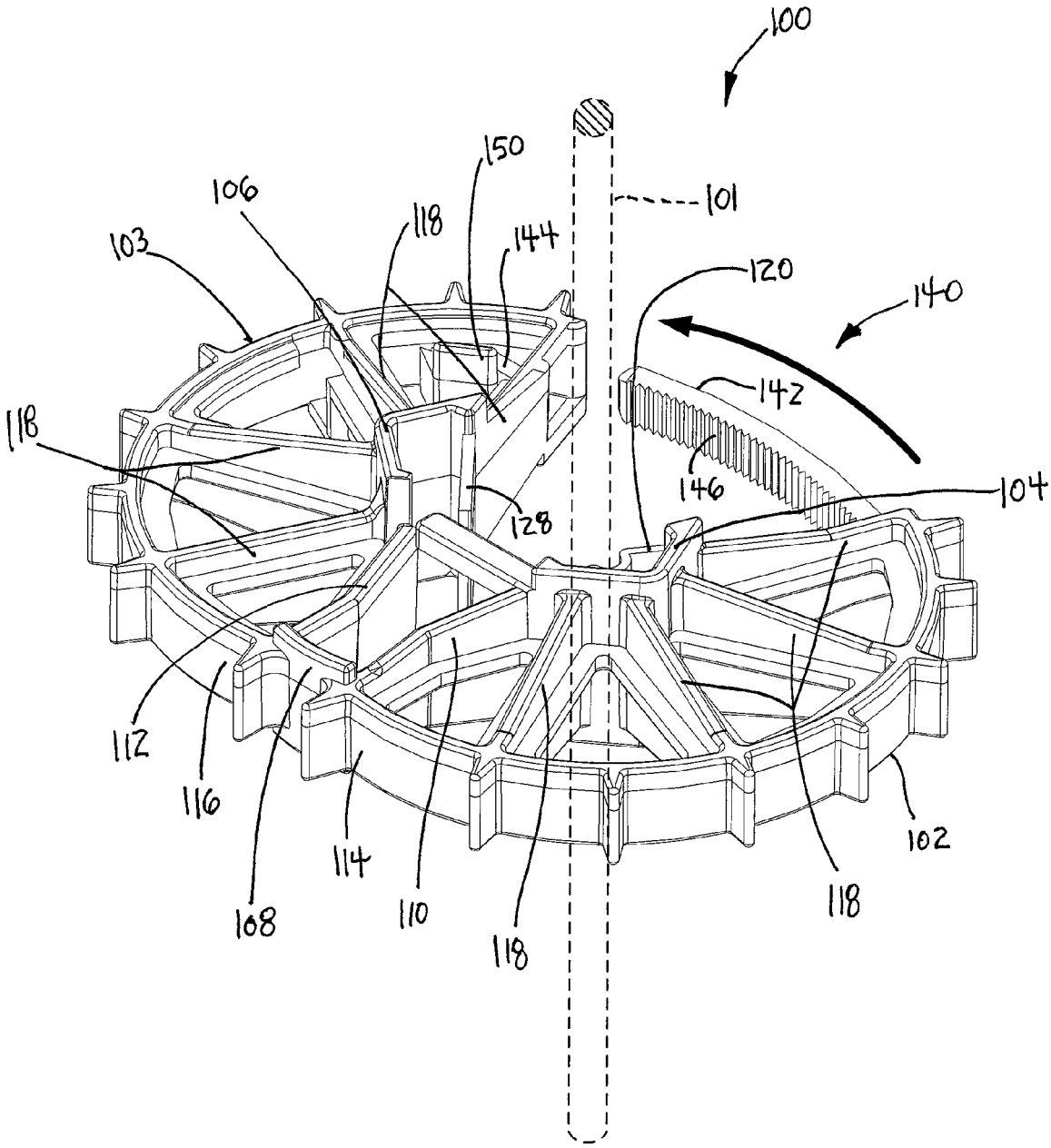
FIG. 1 is a front isometric view of a spacer according to some embodiments of the disclosed subject matter.

Referring now to FIGS. 1-4, some embodiments include a spacer 100 for positioning rods and or wire 101 in concrete (not shown). Spacer 100 includes first and second portions 102 and 103, including saddle portions 104 and 106, respectively, joined together via a connection mechanism 108.

Both of saddle portions 104 and 106 are joined with a spacing member 110 and 112, respectively. First and second outer edges 114 and 116 are joined with spacing members 110 and 112, respectively, opposite first and second saddle portions 104 and 106, also respectively. First and second outer edges 114 and 116 have a curved shape so as to define a substantially circular rim when first and second saddle portions 104 and 106 are positioned adjacent one another. Spacing members 110, 112, and 118 are defined by spokes extending between said first and second saddle portions 104 and 106 and first and second outer edges 114 and 116.

First saddle portion 104 includes a conforming fixed centering tab 120 joined with the first saddle portion at first and second ends 122 and 124. Centering tab 120 includes a centering groove 126.

Figure 2:
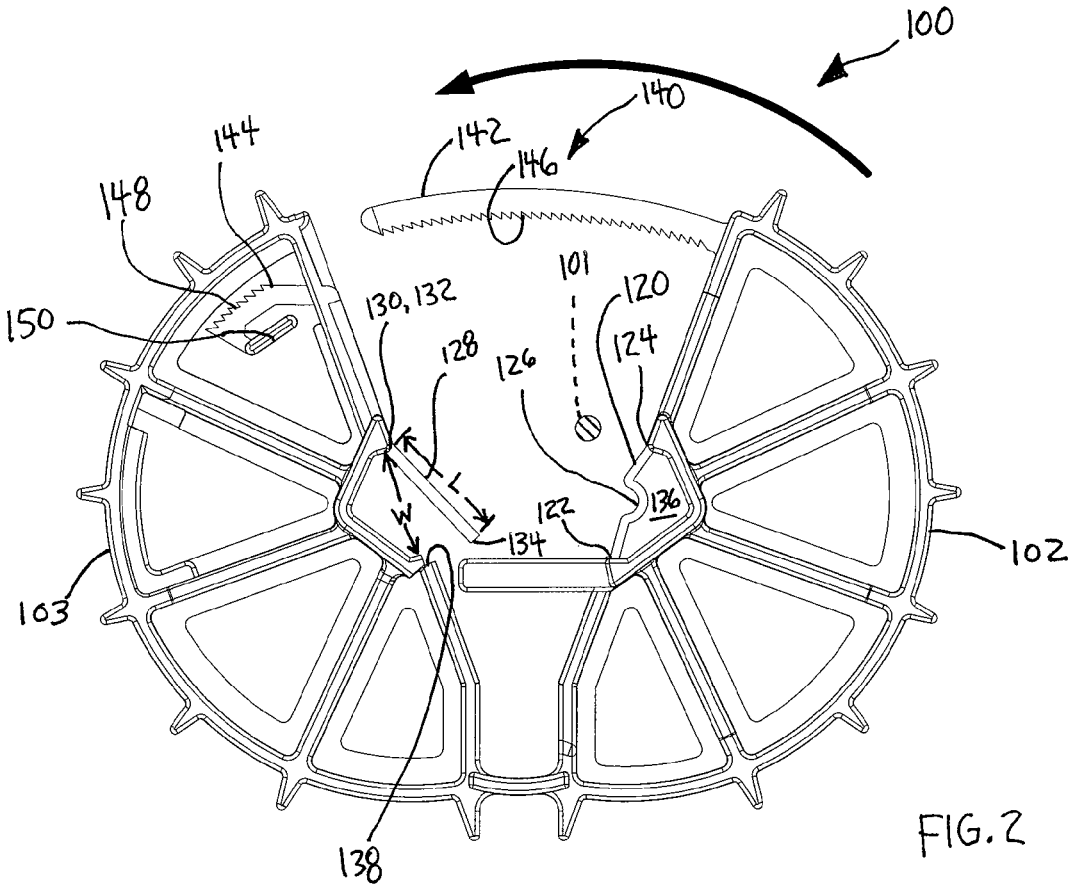
FIG. 2 is a top plan view of a spacer in a first open position according to some embodiments of the disclosed subject matter.
Figure 3:
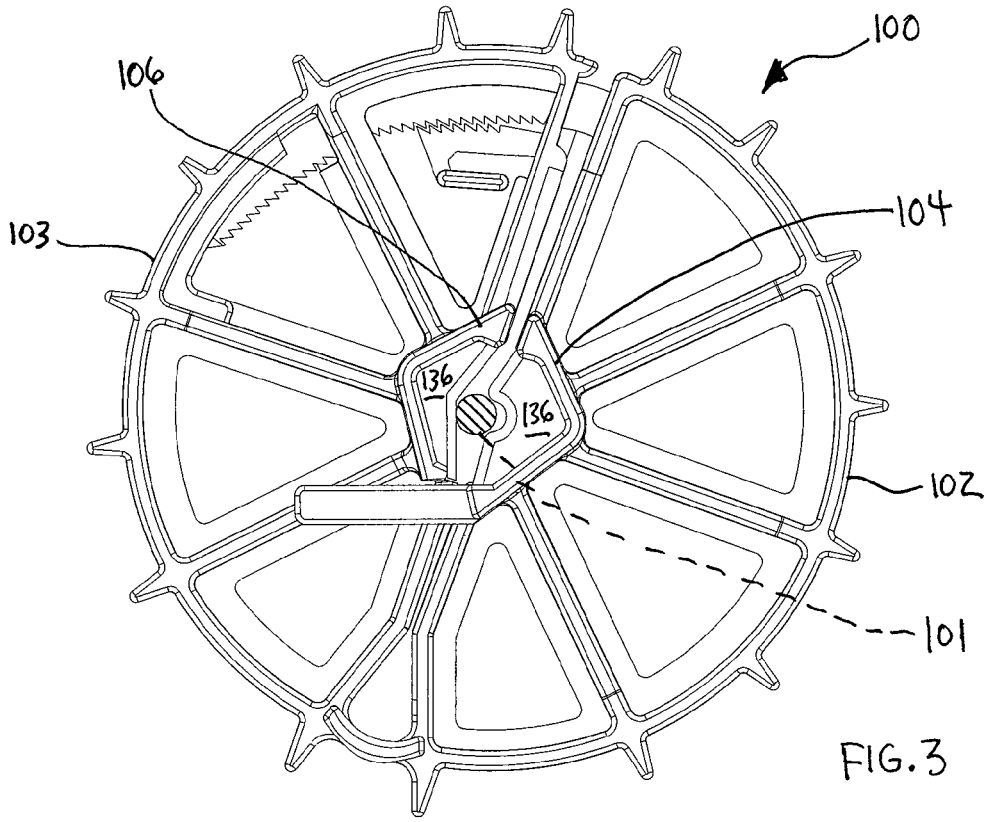
FIG. 3 is a top plan view of a spacer in a second closed position according to some embodiments of the disclosed subject matter.
Figure 4:
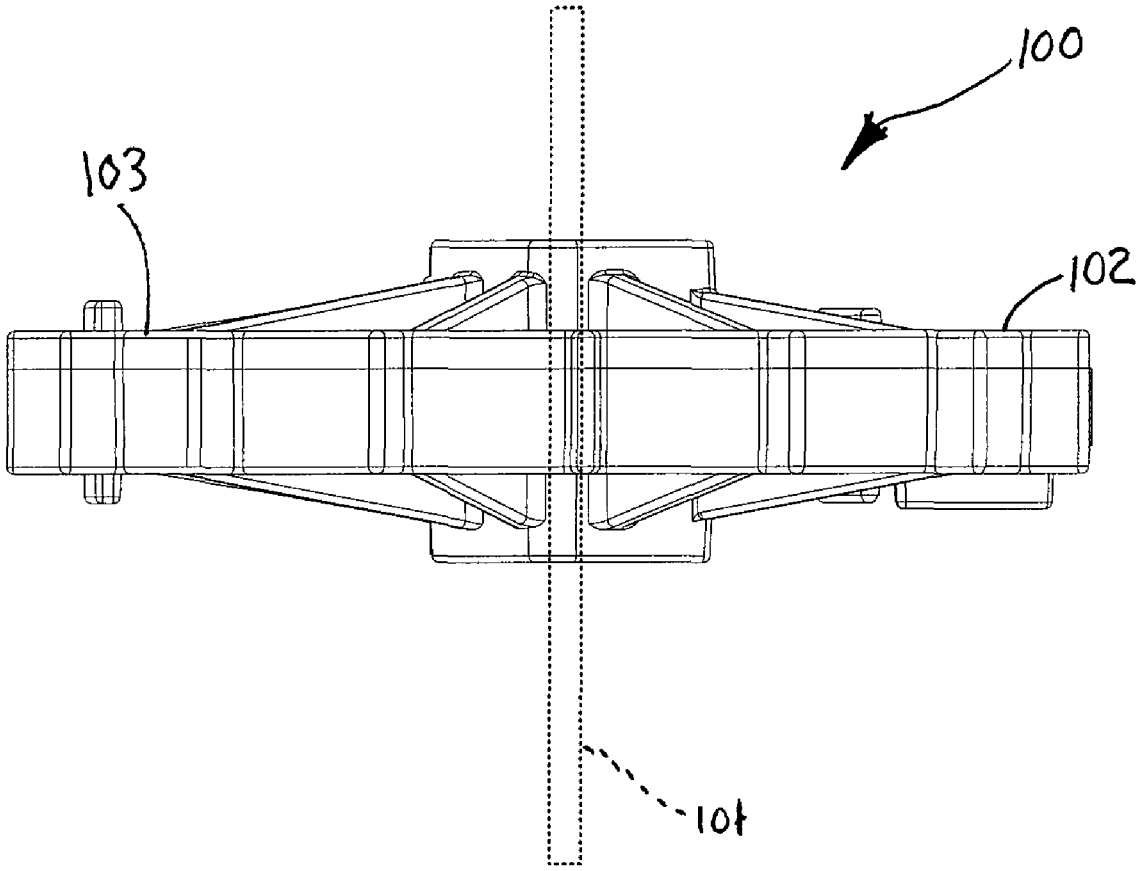
FIG. 4 is a front elevation view of a spacer according to some embodiments of the disclosed subject matter.

Second saddle portion 106 includes an adjustable and conforming centering flap 128 joined with the second saddle portion at a first end 130 via a hinge connection 132 and including a free second end 134 opposite the first end. Centering flap 128 generally has a length L greater than a width W of an opening 136 of second saddle portion 106. Spacing member 112 includes a flap contact surface 138. As best shown in FIG. 2, free second end 134 typically does not contact flap contact surface 138 when in a first position. First position is when spacer 100 is open so that first and second saddle portions 104 and 106 are separated from one another. However, as best shown in FIG. 3, free second end 134 typically contacts flap contact surface 138 when in a second position. Second position is when spacer 100 is closed so that first and second saddle portions 104 and 106 are closed around and clamped to wire 101.

Connection mechanism 108 is joined with spacing members 110 and 112 adjacent outer edges 114 and 116. In some embodiments, connection mechanism 108 is defined by an integral hinge that allows first and second portions 102 and 103 and first and second saddle portions 104 and 106 to be pivoted together and apart.

Spacer 100 includes a mechanism 140 for releasably locking saddle portions 104 and 106 in position after they are pivoted adjacent one another. Mechanism 140 includes a ratchet arm 142 and a ratchet finger 144. Ratchet arm 142 includes teeth 146 and extends from one of first and second outer edges 114 and 116. Ratchet finger 144 is joined with an opposite one of first and second outer edges 114 and 116 than that of ratchet arm 142. Ratchet finger 144 includes teeth 148 that are configured to mate with teeth 146 of ratchet arm 142 and a tab 150 for lifting the ratchet finger. In other embodiments, mechanism 140 can include other known types of releasable locking components.

Spacers according to the disclosed subject matter offer benefits and advantages over known devices. Spacers according to the disclosed subject matter are able to securely position smaller diameter rebar and wire, e.g., wire up to #5 bar, than other known devices.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. A spacer for positioning rods and wire in concrete, said spacer comprising:

a first saddle portion, a spacing member joined with said first saddle portion, and a first outer edge joined with said spacing member opposite said first saddle portion;

a conforming fixed centering tab joined with said first saddle portion at first and second ends, said centering tab including a centering groove;

a second saddle portion, a spacing member joined with said second saddle portion, and a second outer edge joined with said spacing member opposite said second saddle portion;

an adjustable and conforming centering flap joined with said second saddle portion at a first end via a hinge connection and including a free second end opposite said first end, said centering flap having a length greater than a width of an opening of said second saddle portion; and a connection mechanism joined with said spacing members adjacent said outer edges, for pivoting said first and second saddle portions.

2. A spacer according to claim 1, wherein said connection mechanism further comprises an integral hinge connecting said first and second saddle portions.

3. A spacer according to claim 1, further comprising:

a ratchet arm extending from one of said first and second outer edges, said ratchet arm including teeth; and a ratchet finger joined with an opposite one of said first and second outer edges than that of said ratchet arm, said ratchet finger including teeth that are configured to mate with said teeth on said ratchet arm and a tab for lifting said ratchet finger.

4. A spacer according to claim 1, wherein said first and second outer edges have a curved shape so as to define a substantially circular rim when said first and second saddle portions are connected.

5. A spacer according to claim 1, wherein said spacing members are defined by spokes extending between said saddle portions and said outer edges.

6. A spacer according to claim 1, one of said spacing members including a flap contact surface, wherein said free second end does not contact said flap contact surface in a first position, and said free second end contacts said flap contact surface in a second position.

7. A spacer according to claim 1, further comprising a guide member joined with said spacer between said connection mechanism and one of said first and second saddles.

8. A spacer for positioning rods and wire in concrete, said spacer comprising:

a first portion including a first saddle portion, a spacing member joined with said first saddle portion, and a first outer edge joined with said spacing member opposite said first saddle portion, said first saddle portion including a conforming fixed centering tab joined with said first saddle portion at first and second ends, said centering tab including a centering groove;

a second portion including a second saddle portion, a spacing member joined with said second saddle portion, and a second outer edge joined with said spacing member opposite said second saddle portion, said second saddle portion including an adjustable and conforming centering flap joined with said second saddle portion at a first end via a hinge connection and including a free second end opposite said first end, said centering flap having a length greater than a width of an opening of said second saddle portion; and a connection mechanism for releasably connecting said first and second portions so that said first and second saddle portions are positioned adjacent one another to define an aperture for retaining said rods and wire.

9. A spacer according to claim 8, wherein said connection mechanism further comprises an integral hinge connecting said first and second portions.

10. A spacer according to claim 8, further comprising:

a ratchet arm extending from one of said first and second portions, said ratchet arm including teeth; and a ratchet finger joined with an opposite one of said first and second portions than that of said ratchet arm, said ratchet finger including teeth that are configured to mate with said teeth on said ratchet arm and a tab for lifting said ratchet finger.

11. A spacer according to claim 8, wherein said first and second outer edges have a curved shape so as to define a substantially circular rim when said first and second portions are connected.

12. A spacer according to claim 8, wherein said spacing members are defined by spokes extending between said saddle portions and said outer edges.

13. A spacer according to claim 8, one of said spacing members including a flap contact surface, wherein said free second end does not contact said flap contact surface in a first position, and said free second end contacts said flap contact surface in a second position.

14. A spacer according to claim 8, further comprising a guide member joined with said spacer between said connection mechanism and one of said first and second saddles.

* * * * *